United States Patent [19]

Porter et al.

[11] 4,284,108

[45] Aug. 18, 1981

[54] THREAD GRIPPER

[75] Inventors: Allan W. H. Porter, Lustmühle; Anton Lücian, Arbon, both of Switzerland

[73] Assignee: Adolph Saurer Limited, Arbon, Switzerland

[21] Appl. No.: 93,450

[22] Filed: Nov. 13, 1979

[51] Int. Cl.[3] ..... D03D 47/22
[52] U.S. Cl. ..... 139/448
[58] Field of Search ..... 139/447, 448

[56] References Cited

U.S. PATENT DOCUMENTS

| | | | |
|---|---|---|---|
| 3,842,867 | 10/1974 | Volpe | 139/448 |
| 3,934,621 | 1/1976 | Tosches | 139/448 |

*Primary Examiner*—Henry Jaudon
*Attorney, Agent, or Firm*—Bailey, Dority & Flint

[57] ABSTRACT

A thread gripper for a textile thread having a fork-like gripping member with two rigid horns 3, 7, of which the one horn 7 forms a rigid part of the thread gripper. A cushion 5 of soft resilient material is inserted in a recess 4 in the other horn 3. This cushion 5 presses a tongue 6, in order to grip the thread 11. The thread 11 is released by pressure on the nose 9 carried on top of the tongue.

4 Claims, 2 Drawing Figures

1
11a
11
10
2
7
6
8
9
II
12
3
4
5
II
11b 10
7
11b
6
5
4
3
I
9
8
2
11
11a
1
I

THREAD GRIPPER

BACKGROUND OF THE INVENTION

The invention relates to a thread gripper for textile threads with flexible pressing of a movable part against a rigid part to hold the thread.

As a rule, such grippers consist of two parts, generally of metal, which press resiliently against one another and which hold the textile thread situated in between as a result of the frictional force produced by the pressure. The pressure is produced as a result of the fact that at least the one part is either a lamination produced from spring steel which is gripped (rivetted, screwed, pushed into a guide gap or the like) in a carrier with initial stress at one of its ends or is a rigid lever which is articulated pivotally on a carrier and is subject to the action of a spring (generally a spiral spring), in which case the counter part may likewise be constructed in the form of a resilient member.

This kind of thread gripper is comparatively expensive to produce. In addition, the thread grippers with the laminations constructed in the form of spiral springs are liable to break. Excited by vibrations of the loom or of the weft needle when used as a yarn holder, the laminations of the thread grippers often tend towards vibrations, as a result of which the holding force of the thread intermittently approaches zero.

A further disadvantage consists in that the contact faces cannot adapt to differences in thickness in the textiel thread, as a result of which this can be exposed to locally severe pressing.

Furthermore, the known thread grippers are relatively heavy, particularly those with the lever as a movable part, so that when they are used in the weft needle, for example, disadvantages result for this (greater inertia, high pressure on the warp threads of the lower shed or on guide elements of the weft needle).

SUMMARY OF THE INVENTION

According to the invention, this problem is solved in that the thread gripper comprises a fork-shaped member with two horns, of which the one horn forms the rigid part and the other horn carries a cushion of soft resilient material on its inner wall, and that the movable part is formed by a tongue which is guided with play on all sides on the one horn 7 and is prestressed by the cushion against the inside of this horn.

For the sake of simplicity, the cushion may simply be inserted in a recess in the other carrying horn 3, as a result of which its replacement or exchange in the event of a defect or for adaptation of the softness to the necessary pressure or holding force for the thread is made very easy. Rubber or a rubber-like plastics material is preferably used as material for the cushion.

According to another further development of the invention, in order to guide the tongue by the one horn, the tongue is provided with an elongated prismatic nose which penetrates through a correspondingly shaped guide opening in the one horn 7 and projects beyond its outer face. This nose can serve to exert a pressure on the tongue from the outside, as a result of which its pressure contact with the horn is cancelled and the thread is released. This is a particular advantage when the thread gripper is used in a shuttle threading device.

In order to provide as extensive a rotational mobility as possible of the tongue for the uniform distribution of the pressure on the thread gripped between tongue and inner face of the one horn, the contact face between tongue and cushion should preferably be restricted to as narrow a strip as possible about the plane of symmetry of the tongue loading. This can be realized by an appropriate formation either of the cushion or of the tongue or of both parts. From the production point of view, it is more favorable to construct the tongue accordingly. For this purpose, according to a further development of the invention, it is provided that the tongue has an equal-sided, trapezoidal-like cross-section, the narrow side of which is adjacent to the cushion.

Accordingly, it is an important object of the present invention to provide a light thread gripper of simple components which can easily be exchanged, and the movable part of which is movable in all directions, particularly rotatably.

Another important object of the present invention is to provide a relatively simple and positive thread gripper for use on textile equipment.

These and other objects and advantages of the invention will become apparent upon reference to the following specification, attendant claims and drawing.

DESCRIPTION OF A PREFERRED EMBODIMENT

Figure 1:
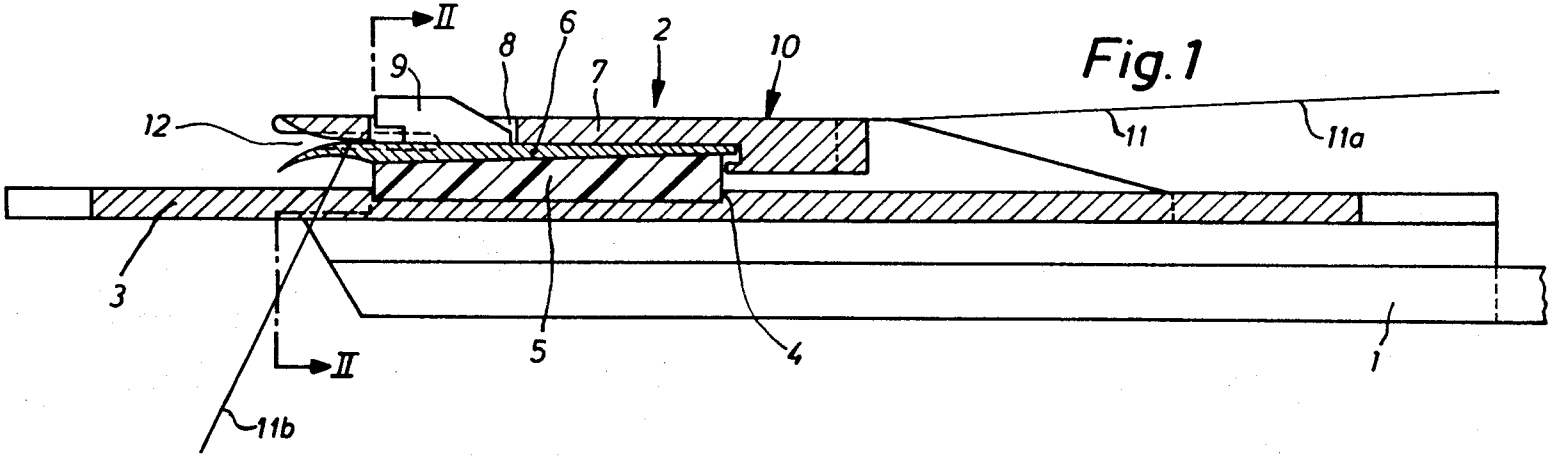
FIG. 1 is a longitudinal section through a thread gripper according to the invention on the line I—I in FIG. 2 and the gripper is shown in a plan view as would appear from the top of the loom.

The reference numeral 1 designates the rod of a picking motion to which a fork-like gripper member 2 with a horn 3 is secured. The horn 3 is provided with a rectangular recess 4 in which a cushion 5 of soft resilient material such as rubber or a rubber-like plastics material is inserted. The cushion 5 practically fills in the internal spacing from the horn 3 to the second horn 7 in height and urges a tongue 6, resting on the cushion 5 against the inside of the second horn 7 of the gripper member 2. The tongue 6 appears trapezoidal-like with equal oblique sides in cross-section and lies with its narrow side on the cushion 5. The horn 7 is provided with a rectangular opening 8 which surrounds an elongated prismatic nose 9 of the tongue 6 with play on all sides. When the tongue 6 is applied against the inside of the horn 7, the nose 9 projects beyond the outer face 10 of the horn.

Figure 2:
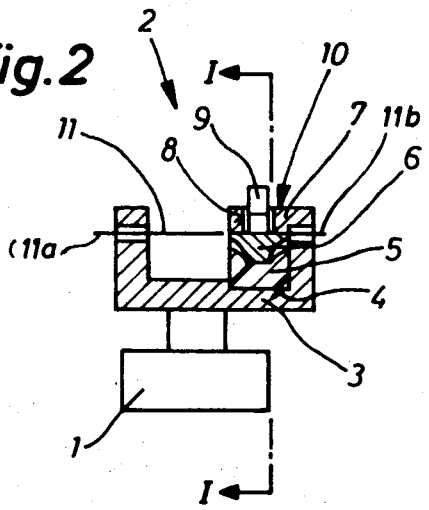
FIG.2 is a cross-section through the thread gripper of FIG. 1 in the plane immediately in front of the nose, on the line II—II.

In FIG. 2, a thread gripped between tongue 6 and inside of the horn 7 is designated by the reference numeral 11. In order to facilitate the insertion of the thread 11, both the tip of the horn 7 and that of the tongue 6 are rounded to form a funnel-like inlet 12.

The portion of the yarn labeled **11*a* in FIG. 1 is being fed to the gripper and the end of the yarn is labeled 11*b***.

For the threading in and for the release of the thread, a force is applied to the nose 9 from the outside, against the pressure of the cushion 5, as a result of which the tongue 6 comes free of the inner face of the horn 7 so that a threading or removal path for the thread 11 is free.

For the removal of the tongue 6 or of the cushion 5 for its replacement, the procedure is similar until the nose 9 has travelled completely out of the opening 8.

Then first the tongue 6 and then also the cushion 5 can easily be removed from the gap between the horns 3 and 7.

While a preferred embodiment of the invention has been described using specific terms, such description is for illustrative purposes only, and it is to be understood that changes and variations may be made without departing from the spirit or scope of the following claims.

What is claimed is:

1. A thread gripper for textile threads comprising:

a pair of horns (3, 7), one of said horns (7) being held rigid;

a cushion (5) of soft resilient material carried by said other horn (3);

said cushion being of rubber or rubber-like plastic material;

a movable tongue (6) carried on said cushion (5) and being prestressed by said cushion against an inside of said rigid horn (7);

whereby a thread positioned between said movable tongue (6) and said inside of said rigid horn (7) is securely held.

2. A thread gripper as set forth in claim 1 further comprising:

a recess provided in said other horn, said cushion (5) being carried in said recess.

3. A thread gripper as set forth in claim 1 further comprising:

said tongue having a nose which penetrates through a correspondingly shaped guide opening in said one horn (7) and projects beyond its outer face (10).

4. A thread gripper as set forth in claim 1 further comprising:

said tongue having an equal-sided trapezoidal cross-section, the narrow side of which is adjacent to said cushion (5).

* * * * *